US005187524A

United States Patent [19]

Cherian

[11] Patent Number: 5,187,524

[45] Date of Patent: Feb. 16, 1993

[54] DEVELOPER DISPENSING APPARATUS WITH COMPOSITE TONER DISPENSER SPRING

[75] Inventor: Abraham Cherian, Webster, N.Y.

[73] Assignee: Xerox Corporation, Stamford, Conn.

[21] Appl. No.: 742,804

[22] Filed: Aug. 9, 1991

[51] Int. Cl.[5] ..... G03G 15/06

[52] U.S. Cl. ..... 355/260; 156/173; 156/175; 355/245; 366/320

[58] Field of Search ..... 355/260, 245, 246, 200, 355/204, 206, 208, 209; 118/652; 222/DIG. 1; 267/149, 166; 174/74; 366/320; 264/281; 156/148, 173, 175, 169

[56] References Cited

U.S. PATENT DOCUMENTS

| | | | |
|---|---|---|---|
| 3,985,097 | 10/1976 | Sitton | 118/425 |
| 4,071,834 | 1/1978 | Comte | 156/175 X |
| 4,224,463 | 9/1980 | Koerber et al. | 174/47 |
| 4,473,217 | 9/1984 | Hashimoto | 267/149 |
| 4,693,324 | 9/1987 | Choiniere et al. | 174/47 |
| 4,724,459 | 2/1988 | Ford | 355/245 X |
| 4,753,423 | 6/1988 | Ukai et al. | 267/286 |
| 4,763,882 | 8/1988 | Nishiyama et al. | 267/33 |
| 4,819,578 | 4/1989 | Koiso et al. | 118/652 |
| 4,935,783 | 6/1990 | Fujisawa | 355/246 |
| 4,943,830 | 7/1990 | Sulenski | 355/245 |
| 4,956,675 | 9/1990 | Joseph | 355/251 |
| 4,977,429 | 12/1990 | Tani et al. | 355/260 |
| 5,098,493 | 3/1992 | Taylor | 156/286 X |

*Primary Examiner*—A. T. Grimley
*Assistant Examiner*—T. A. Dang
*Attorney, Agent, or Firm*—Oliff & Berridge

[57] ABSTRACT

A helical spring is disclosed for transporting developer material in an electrostatographic printer. The helical spring rotates within a conduit for transporting developer from a toner dispenser cartridge to the developer toner roll, or from a cleaning station adjacent the photoreceptor to a waste bottle. The spring can be made of twisted or braided wires coated with a protective coating.

29 Claims, 5 Drawing Sheets

DEVELOPER DISPENSING APPARATUS WITH COMPOSITE TONER DISPENSER SPRING

BACKGROUND OF THE INVENTION

The present invention relates to developer storage and dispensing apparatus. More specifically, the present invention is directed to developer dispensing apparatus for a developer station in an automatic electrostatographic printing machine.

Generally, in the process of electrostatographic printing, a photoconductive insulating member is charged to a substantially uniform potential to sensitize the surface thereof. The charged portion of the photoconductive insulating layer is thereafter exposed to a light image of an original document to be reproduced. This records an electrostatic latent image on the photoconductive member corresponding to the information areas contained within the original document. Alternatively, in a printing application, the electrostatic latent image may be created electronically by exposure of the charged photoconductive layer by an electronically controlled laser beam. After recording the electrostatic latent image on the photoconductive member, the latent image is developed by bringing a developer material charged of opposite polarity into contact therewith. In such processes, the developer material may comprise a mixture of carrier particles and toner particles or toner particles alone. Toner particles are attracted to the electrostatic latent image to form a toner powder image which is subsequently transferred to copy sheet and thereafter permanently affixed to copy sheet by fusing.

In such automatic printing machines, the toner material is consumed in a development process and must be periodically replaced within the development system in order to sustain continuous operation of the machine. Various techniques have been used in the past to replenish the toner supply. Initially, new toner material was added directly from supply bottles or containers by pouring into the dispensing apparatus fixed in the body of the automatic reproducing machine. The addition of such gross amounts of toner material altered the triboelectric relationship between the toner and the carrier in the developer resulting in reduced charging efficiency of the individual toner particles and accordingly a reduction of the development efficiency when developing the electrostatographic latent image on the image bearing surface. In addition, the pouring process was both wasteful and dirty in that some of the toner particles became airborne and would tend to migrate into the surrounding area and other parts of the machine. Accordingly, separate toner or developer hoppers with a dispensing mechanism for adding the toner from the hopper to the developer apparatus in the automatic printing machines on a regular or as needed basis have been provided. In addition, it has been common practice to provide replenishing toner supplies in a sealed container which, when placed in the automatic printing machine, can be automatically opened to dispense toner. In such systems as necessary, the developer may be dispensed from the container relatively uniformly. Further, difficulty may arise in uniformly dispensing the developer, in that with a large mass of toner particles, which frequently are somewhat tacky, the particles may tend to agglomerate, become compacted, and form a bridging structure in the toner container. In addition, with the use of removable or replaceable developer cartridges, and due to the relative high cost of the developer contained therein, it is desirable to remove as much of the developer as possible during the dispensing operation from the cartridge so that only a minimal quantity of developer is not consumed in the dispensing operation and subsequently utilized in the formation of images. Excessive quantities of developer undispensed and remaining in an empty developer cartridge will increase the cost per copy to the consumer.

Various devices have been used to overcome the above-noted problems. For example, in U.S. Pat. No. 4,739,907 a spring auger is provided in a dispenser apparatus which is replaceable within the machine. In this system, the auger is driven about one end in rotation to move toner. Problems can develop, however, when such an auger spring is used to transport toner along nonlinear paths. For example, it may be desirable to transport toner along a tortuous path within the electrostatographic printing apparatus. A single metal wire auger spring, as used in the art for dispensing toner, will prematurely break when used at large angles.

SUMMARY OF THE INVENTION

It is an object of the present invention to provide a developer storage and dispensing apparatus which uniformly dispenses toner along a non-linear pathway.

It is another object of the present invention to provide a spring auger which is strong and durable and can be bent at sharp angles for transporting toner.

It is still another object of the present invention to provide a spring auger formed from three braided wires and coated with a plastic covering.

It is yet another object of the present invention to provide a process for making coated auger springs by twisting and heating wires and passing the wires into a fluidized bed of plastic particles.

It is another object of the present invention to provide a coated auger spring, the coating being of varying thickness along the length of the spring.

These and other objects of the present invention are accomplished by providing a developer storage and dispensing apparatus having an auger spring formed from braided wires coated with a plastic coating of variable thickness along the length of the spring. The plastic coating helps to attach the individual wires together and increase the stiffness of the spring and reduce the friction of the spring within the toner transport passageway.

BRIEF DESCRIPTIONS OF THE DRAWINGS

The invention will now be described by reference to a preferred embodiment in conjunction with the appended drawings in which.

DETAILED DESCRIPTION OF THE PREFERRED EMBODIMENT

Figure 1:
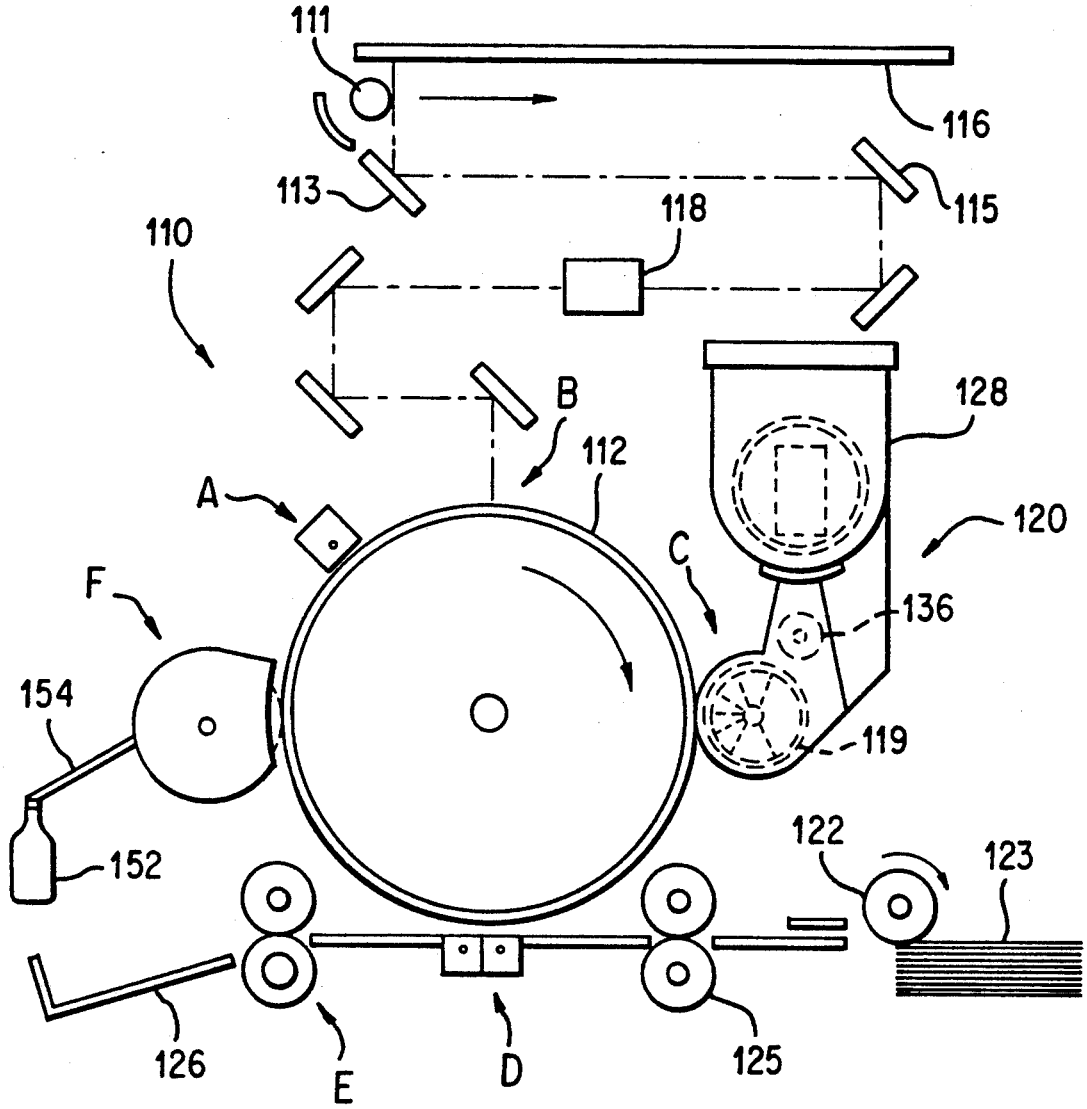
FIG. 1 is a schematic representation of an automatic printing machine which may use the transport spring mechanism according to the present invention.

Referring now to FIG. 1, there is shown an automatic xerographic printing machine 110 including a developer assembly which has a removable developer storage and a dispensing cartridge 120 according to the present invention. As used herein, the term developer is intended to define all mixtures of toner and carrier as well as toner or carrier alone. The printer includes a photosensitive drum 112 which is rotated in the direction indicated by the arrow to pass sequentially through a series of xerographic processing stations; a charging station A, an imaging station B, a developer station C, a transfer station D and cleaning station F.

A document to be reproduced is placed on imaging platen 116 and scanned by a moving optical system including a lamp 111 and mirrors 113 and 115 and stationary lens 118 to produce a flowing light image on the drum surface which has been charged at charging station A. The image is then developed at development station C to form a visible toner image. A development station C includes a developer roll 119 which may, for example, provide a magnetic brush of developer to the drum 112 which is supplied with developer from the removable developer storage and dispensing cartridge 120 according to the present invention by auger 121. The top sheet 123 and a supply of cut sheets is fed by feed roll 122 to registration rolls 125 in synchronous relationship with the image on the drum surface of the transfer station D. Following transfer of the toner image to the copy sheet, the copy sheet is stripped from the drum surface and directed to the fusing station E to fuse the toner image on the copy sheet after which the drum surface itself continues to cleaning station F where residual toner remaining on the drum surface is removed prior to the drum surface again being charged at charging station A. Upon leaving the fuser, the copy sheet with the fixed toner image thereon is transported to sheet collecting tray 126.

The developer storage and dispensing apparatus 120 includes a generally cylindrical elongated container 128 with a dispensing opening at the bottom. Developer is dispensed from the dispersing opening with the developer falling by gravity into auger assembly 136 which delivers the developer to the developer sump associated with the developer roll 119. If the auger assembly is not directly below the dispensing opening, a means for transporting the developer is necessary, which, in accordance with the present invention is a particular helical spring member. In addition, such a transporting means is also useful for transporting developer from cleaning station F along conduit 154 to waste bottle 152.

Figure 2:
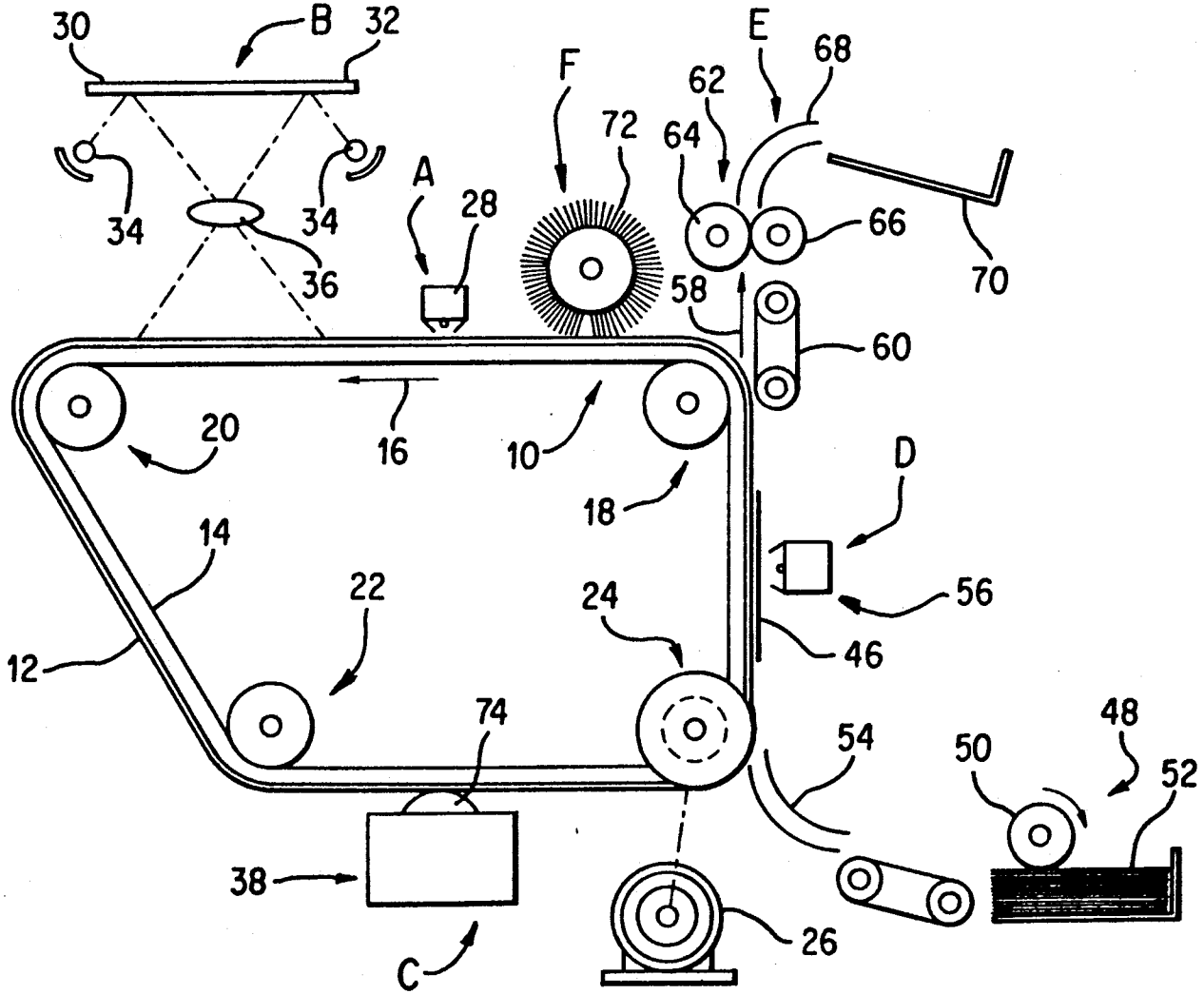
FIG. 2 is a schematic elevational view depicting a web-type electrophotographic printing machine which may use the transport spring mechanism of the present invention.

The use of the spring of the present invention is also applicable to electrophotographic printing using a belt-type photoconductor rather than a drum. As can be seen in FIG. 2, such an electrophotographic printing machine employs a belt 10 having a photoconductive surface 12 deposited on a conductive substrate 14. Preferably, photoconductive surface 12 is made from a selenium alloy with conductive substrate 14 being made from a aluminum alloy which is electrically grounded. Other suitable photoconductive surfaces and conductive substrates may also be employed. Belt 10 moves in the direction of arrow 16 to advance successive portions of photoconductive surface 12 through the various processing stations disposed about the path of movement thereof. As shown, belt 10 is entrained about rollers 18, 20, 22 and 24. Roller 24 is coupled to motor 26 which drives roller 24 so as to advance belt 10 in the direction of arrow 16. Rollers 18, 20, and 22 are idler rollers which rotate freely as belt 10 moves in the direction of arrow 16.

Initially, a portion of belt 10 passes through charging station A. At charging station A, a corona generating device, indicated generally by the reference numeral 28, charges a portion of photoconductive surface 12 of belt 10 to a relatively high, substantially uniform potential.

Next, the charged portion of photoconductive surface 12 is advanced through exposure station B. At exposure station B, an original document 30 is positioned face down upon a transparent platen 32. Lamps 34 flash light rays onto original document 30. The light rays reflected from original document 30 are transmitted through lens 36 forming a light image thereof. Lens 36 focuses the light image onto the charged portion of photoconductive surface 12 to selectively dissipate the charge thereon. This records an electrostatic latent image on photoconductive surface 12 which corresponds to the informational areas contained within original document 30 disposed upon transparent platen 32. Thereafter, belt 10 advances the electrostatic latent image recorded on photoconductive surface 12 to development station C.

At development station C, a developer unit, indicated generally by the reference numeral 38, transports a single component developer material of toner particles into contact with the electrostatic latent image recorded on photoconductive surface 12. Toner particles are attracted to the electrostatic latent image forming a toner powder image on photoconductive surface 12 of belt 10 so as to develop the electrostatic latent image.

After development, belt 10 advances the toner powder image to transfer station D. At transfer station D, a sheet of support material 46 is moved into contact with the toner powder image. Support material 46 is advanced to transfer station D by a sheet feeding apparatus, indicated generally by the reference numeral 48. Preferably, sheet feeding apparatus 48 includes a feed roll 50 contacting the upper most sheet of a stack of sheets 52. Feed roll 50 rotates to advance the upper most sheet from stack 50 into chute 54. Chute 54 directs the advancing sheet of support material 46 into contact with photoconductive surface 12 of belt 10 in a timed sequence so that the toner powder image developed thereon contacts the advancing sheet of support material at transfer station D.

Transfer station D includes a corona generating device 56 which sprays ions onto the backside of sheet 46. This attracts the toner powder image from photoconductive surface 12 to sheet 46. After transfer, the sheet continues to move in the direction of arrow 58 onto a conveyor 60 which moves the sheet to fusing station E.

Fusing station E includes a fuser assembly, indicated generally by the reference numeral 62, which permanently affixes the powder image to sheet 46. Preferably, fuser assembly 62 includes a heated fuser roller 64 and a back-up roller 66 with the toner powder image contacting fuser roller 64. In this manner, the toner powder image is permanently affixed to sheet 46. After fusing, chute 68 guides the advancing sheet to catch tray 70 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a preclean corona generating device (not shown) and a rotatably mounted fibrous brush 72 in contact with photoconductive surface 12. The pre-clean corona generator neutralizes the charge attracting the particles to the photoconductive surface. These particles are cleaned from the photoconductive surface by the rotation of brush 72 in contact therewith. Subsequent to cleaning, a discharge lamp (not shown) floods photoconductive surface 12 with light to dissipate any residual charge remaining thereon prior to the charging thereof for the next successive imaging cycle.

It is believed that the foregoing description is sufficient for purposes of the present application to illustrate the general operation of an exemplary electrophotographic print machine incorporating the features of the present invention therein.

Figure 3:
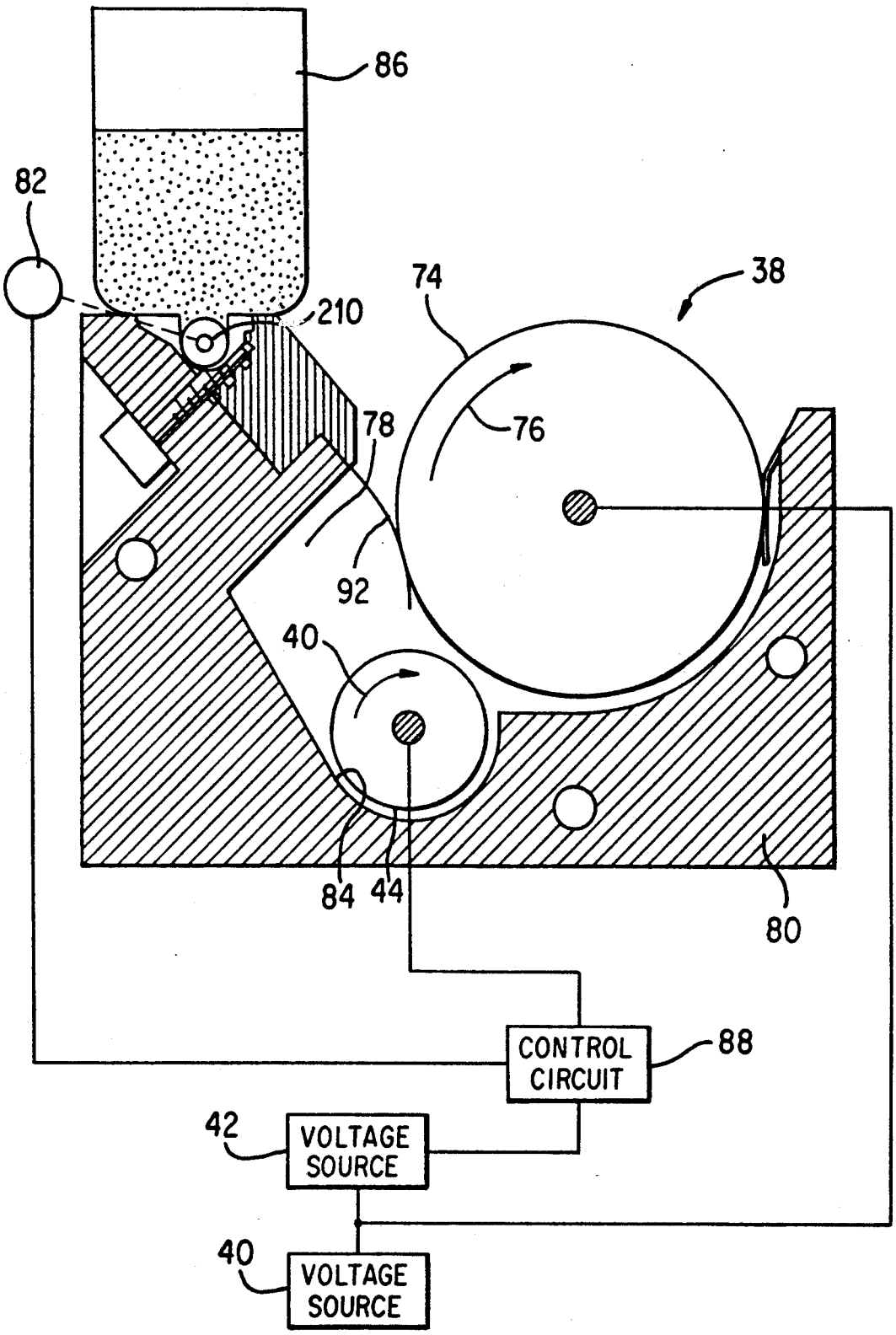
FIG. 3 is a schematic elevational view showing the developing apparatus of FIG. 2.

Referring now to FIG. 3, the detailed structure of developer unit 38 is shown. The developer unit includes a donor roller 74. Donor roller 74 may e a bare metal such as aluminum. Alternatively, the donor roller may be a metal roller coated with a material. For example, a polytetrafluoroethylene based resin such as Teflon, a trademark of the DuPont Corporation, or a polyvinylidene fluoride based resin, such as Kynar, a trademark of the Pennwalt Corporation, may be used to coat the metal roller. This coating acts to assist in charging the particles adhering to the surface thereof. Still another type of donor roller may be made from stainless steel plated by a catalytic nickel generation process and impregnated with Teflon. The surface of the donor roller is roughened from a fraction of a micron to several microns, peak to peak. An electrical bias is applied to the donor roller. The electrical bias applied on the donor roller depends upon the background voltage level of the photoconductive surface, the characteristics of the donor roller, and the spacing between the donor roller and the photoconductive surface. It is thus clear that the electrical bias applied on the donor roller may vary widely. Donor roller 74 is coupled to a motor which rotates donor roller 74 in the direction of arrow 76. Donor roller 74 is positioned, at least partially, in chamber 78 of housing 80.

A toner mixer, indicated generally by the reference numeral 44, mixes and fluidizes the toner particles. The fluidized toner particles seek their own level under the influence of the gravity. Inasmuch as new toner particles are being discharged from container 86 into one end of the chamber 78 of housing 80, the force exerted on the fluidized toner particles by the new toner particles being added at that end moves the fluidized toner particles from that end of housing 80 to the other end thereof. Toner mixer 44 is an elongated member located in chamber 78 closely adjacent to an arcuate portion 84 of housing 80. Arcuate portion 84 is closely adjacent to elongated member 44 and wraps about a portion thereof. There is a relatively small gap or space between arcuate portion 84 and a portion of elongated member 44. New toner particles are discharged into one end of chamber 78 from container 86. As elongated member 44 rotates in the direction of arrow 40, toner particles are mixed and fluidized. The force exerted on the fluidized toner particles by the new particles being discharged into chamber 78 advances the fluidized toner particles from the end of the chamber in which the new toner particles have been discharged to the other end thereof. The fluidized toner particles being moved are attracted to donor roller 74.

Voltage source 42 is electrically connected to elongated member 44 by control circuit 88. Voltage source 40 is connected to voltage source 42 and donor roll 74. Voltage sources 40 and 42 are DC voltage sources. This establishes an electrical bias between donor roll 74 and toner mixer 44 which ranges from about 250 volts to about 1000 volts. Preferably, an electrical bias of about 600 volts is applied between donor roller 74 and toner mixer 44. The current biasing the toner mixer is a measure of toner usage. Control circuit 88 detects the current biasing the toner mixer 44 and, in response thereto, generates a control signal. The control signal from control circuit 88 regulates the energization of motor 82.

Motor 82 is connected to helical coil 210 located in the open end of container 86. As coil 210 rotates, it discharges toner from container 86 into chamber 78 of housing 80. Toner mixer 44 is spaced from donor roller 74 to define a gap therebetween. This gap may range from about 0.05 centimeters to about 0.15 centimeters. Donor roller 74 rotates in the direction of arrow 76 to move the toner particles attracted thereto into contact with the electrostatic latent image recorded on photoconductive surface 12 of belt 10. As donor roller 74 rotates in the direction of arrow 76, charging blade 92 has the region of the free end thereof resiliently urged into contact with donor roller 74. Charging blade 92 may be made from a metal, silicone rubber, or a plastic material. By way of example, charging blade 92 may be made from steel phosphor bronze and ranges from about 0.025 millimeters to about 0.25 millimeters in thickness, being a maximum of 25 millimeters wide. The free end of the charging blade extends beyond the tangential contact point with donor roller 74 by about 4 millimeters or less. Charging blade 82 is maintained in contact with donor roller 74 at a pressure ranging from about 10 grams per centimeter to about 250 grams per centimeter. The toner particle layer adhering to donor roller 74 is charged to a maximum of 60 microcoulombs/gram with the toner mass adhering thereto ranging from about 0.1 milligrams per centimeter$^2$ to about 2 milligrams per centimeter$^2$ of roll surface.

Figure 4:
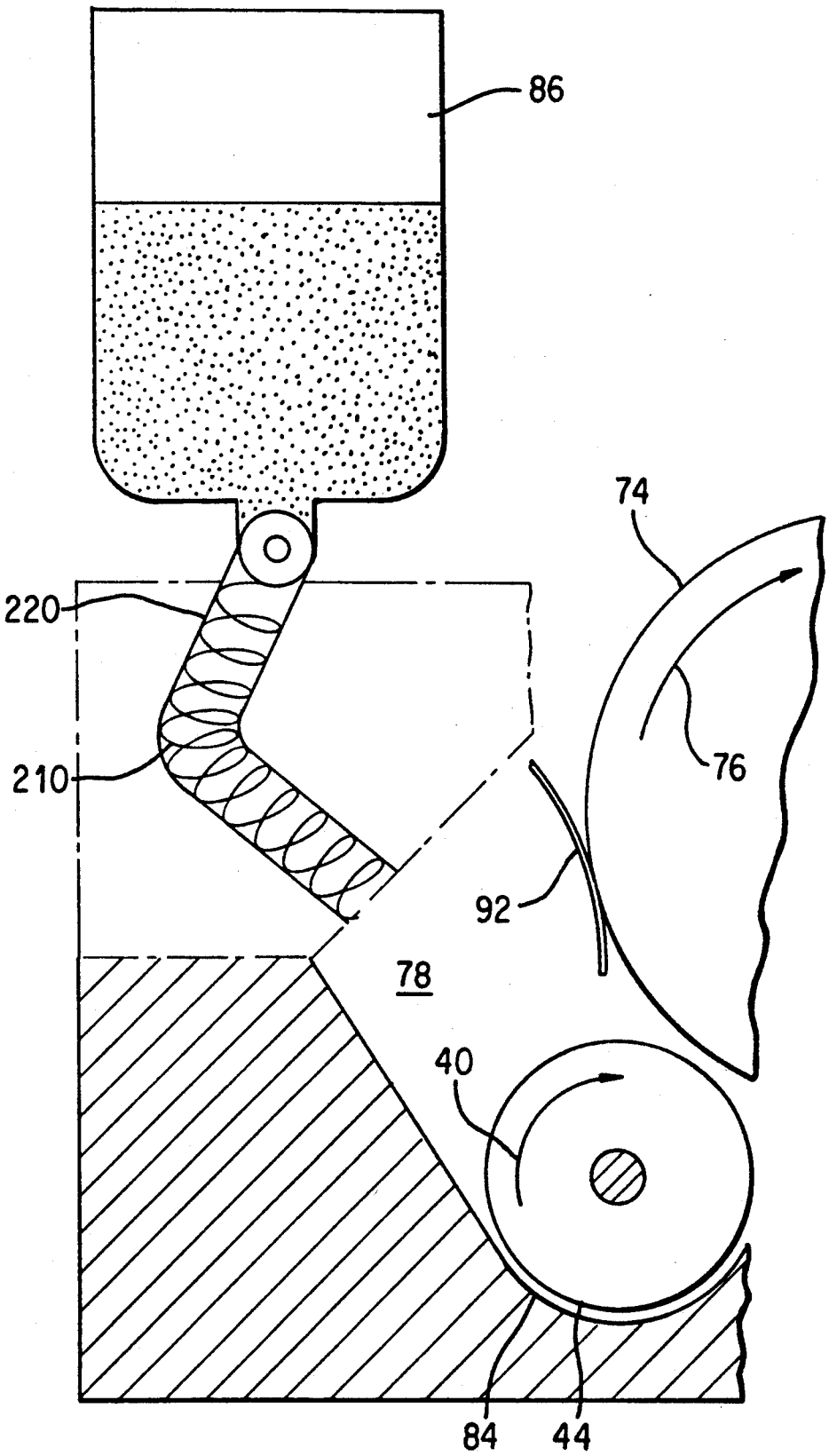
FIG. 4 is a schematic cross-sectional view of a nonlinear passageway for transporting toner via rotation of the spring auger.

As can be seen in FIG. 4, it is necessary for the developer to be transferred between different areas within the printing apparatus, such as from container 86 to donor roller 74. In addition, after the developer is applied to the photoreceptor at the developer station C, and a portion of the developer is transferred to the cut sheets at transfer station D, any remaining developer on the photoreceptor must be removed at cleaning station F. This removed developer at cleaning station F must be transported away from the photoreceptor. The removed the photoreceptor must be removed at cleaning station F. This removed developer at cleaning station F must be transported away from the photoreceptor. The removed excess developer can be transported to an excess waste bottle with the helical coil of the present invention.

Figure 5:
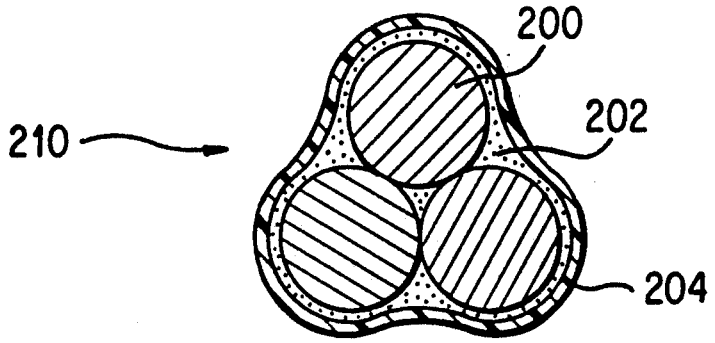
FIG. 5 is a closeup view of a portion of the spring auger in FIG. 4.
Figure 6:
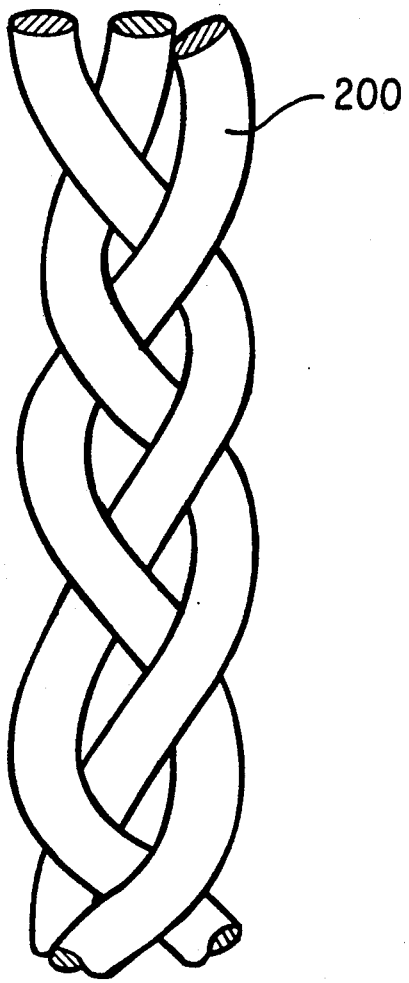
FIG. 6 is a view of the multiple wires used for forming the helical string auger coil of FIGS. 4 and 5.

An effective means for the above-noted transport of the developer material is via passageway 220 having helical spring 210 therein. Because the spring is flexible, the transport passageway for the developer can be nonlinear. In a preferred embodiment of the present invention, the helical coil in the transport passageway has two or more, though preferably three wound or braided wires that form a helical coil within the transport path. As can be seen in FIG. 5, individual wires 200 can be used to make up the coil, the wires being made of, for example, fiber glass or a metal such as steel. As shown in FIG. 6, the individual wires are preferably braided. The wires can also be parallel strands or twisted. After braiding, or twisting, the wires are coated with a coating 202 which helps to keep the loose wires together and increase the stiffness of the helical coil. The coating also helps to prevent developer material from becoming imbedded within the braided or twisted wires, and in addition reduces the friction between the helical coil and the transport passageway as the coil rotates in the passageway via motor 82, and significantly prolongs the life of the coil. A second protective coating 204 can also applied. The coatings can be any suitable material that provides sufficient lubricity, strength and durability, such as nylon or Kynar TM.

The coating on the wire strands can have a varying thickness to allow for different stiffness requirements. For example, where there is a sharp bend in the transport passageway, a thinner coating (e.g. about 2/1000 in.) can be used, and in a linear portion of the passageway a thicker coating (e.g. about 5/1000 in.) may be employed. The coating can be applied to the braided wires by passing the heated wires into a fluidized bed of particles.

The developer transport system of the present invention has been described in connection with the preferred embodiments. It will be appreciated by those skilled in the art, however, that additions, modifications, substitutions and deletions not specifically described may be made without departing from the spirit and scope of the invention defined in the appended claims. For example, the number of wires used in the present invention can be a number other than three. Also, though the individual wires are preferably a metal such as steel, it is also possible to utilize other materials for the individual wire strands, such as polymer based fibers.

What is claimed is:

1. A developer transport device comprising:
a developer transport passageway;
a helical coil rotatably disposed within said passageway, wherein said helical coil comprises a plurality of wires bound together and coated with at least one protective coating, said helical coil having at least two portions, one portion of said helical coil having a thin protective coating thereon, another portion of said helical coil having a thick protective coating thereon, said thick protective coating being thicker than said thin protective coating, said another portion of the helical coil being stiffer than said one portion of the helical coil.

2. The developer transport device of claim 1, wherein from 2 to 8 wires are bound together.

3. The developer transport device of claim 2, wherein 3 wires are bound together.

4. The developer transport device of claim 1, wherein said wires are bound together by one of braiding and twisting.

5. The developer transport device of claim 1, wherein said at least one coating is a polymeric coating.

6. The developer transport device of claim 1, wherein said at least one coating comprises a lubricant.

7. The developer transport device of claim wherein said wires are made of fiberglass or metal.

8. The developer transport device of claim 7, wherein said wires are made of metal, the metal comprising steel.

9. The developer transport device of claim 1, wherein said passageway comprises at least one straight portion and at least one bent portion bent at an angle to the straight portion.

10. The developer transport device of claim 9, wherein said coating on said helical coil is thicker on said coil where said coil is disposed in said at least one straight portion, than the coating where said coil is disposed in said at least one bent portion.

11. An electrostatographic printer comprising:
a photoreceptor;
charging means for creating a latent image on said photoreceptor;
means for holding new developer material;
transport means for transporting new developer material from said holding means to said photoreceptor;
developer applying means for applying developer material to said photoreceptor;
transfer means for transferring substantially all of said applied developer material to a sheet of support material, wherein developer material not transferred to said sheet is residue developer material;
removal means for removing the residue developer from said photoreceptor;
wherein at least one of said transport means and said removal means comprises:
a developer transport passageway;
a helical coil rotatably disposed within said passageway, said coil comprising a plurality of wires bound together, said helical coil having at least two portions, one portion of said helical coil having a thin protective coating thereon, another portion of said helical coil having a thick protective coating thereon, said thick protective coating being thicker than said thin protective coating, said another portion of the helical coil being stiffer than said one portion of the helical coil.

12. The printer of claim 11, wherein said bound wires are coated with at least one protective coating.

13. The printer of claim 12, wherein from 2 to 8 wires are bound together.

14. The printer of claim 13, wherein 3 wires are bound together.

15. The printer of claim 12, wherein said wires are bound together by one of braiding and twisting.

16. The printer of claim 12, wherein said at least one coating is a polymeric coating.

17. The printer of claim 12, wherein said at least one coating comprises a lubricant.

18. The printer of claim 12, wherein said wires are made of fiberglass or metal.

19. The printer of claim 18, wherein said wires are made of metal, the metal comprising steel.

20. The printer of claim 12, wherein said passageway comprises at least one straight portion and at least one bent portion bent at an angle to the straight portion.

21. The printer of claim 20, wherein said at least one coating on said helical coil is thicker on said coil where said coil is disposed in said at least one straight portion, than where said coil is disposed in said at least one bent portion.

22. A helical coil having a length comprising:
at least two individual wires;
wherein said wires are bound together, coated with at least one protective coating, and formed in a substantially helical shape, and wherein said at least one coating is of a variable thickness along the length of the coil to impart differing stiffness characteristics to areas of said coil, a coil area of one stiffness having one thickness of coating continuously provided therealong and a coil area of another stiffness greater than said one stiffness having another thickness of coating provided continuously therealong, said another thickness of coating being thicker than said one thickness of coating.

23. The coil of claim 22, wherein from 2 to 8 wires are bound together.

24. The coil of claim 23, wherein 3 wires are bound together.

25. The coil of claim 22, wherein said wires are bound together by braiding or twisting.

26. The coil of claim 22, wherein said at least one coating is a polymeric coating.

27. The coil of claim 22, wherein said at least one coating comprises a lubricant.

28. The coil of claim 22, wherein said wires are made of fiberglass or metal.

29. The coil of claim 28, wherein said wires are made of metal, the metal comprising steel.

* * * * *